United States Patent [19]

Varley, III

[11] Patent Number: 4,881,675

[45] Date of Patent: Nov. 21, 1989

[54] APPARATUS FOR DISPENSING STRIP MATERIAL FROM A ROLL

[76] Inventor: George J. Varley, III, 136 Locust St., McKees Rocks, Pa. 15136

[21] Appl. No.: 190,579

[22] Filed: May 5, 1988

[51] Int. Cl.[4] ..... A47K 10/36

[52] U.S. Cl. ..... 225/43; 225/52; 225/53; 225/74; 225/85

[58] Field of Search ..... 225/75, 74, 73, 72, 225/43, 39, 51, 52, 53, 1, 4, 5, 82, 84, 85

[56] References Cited

U.S. PATENT DOCUMENTS

| | | | |
|---|---|---|---|
| 1,159,837 | 11/1915 | Handy | 225/75 |
| 2,132,177 | 10/1938 | Mezoff | 225/84 |
| 2,400,776 | 5/1946 | Nordeen et al. | 225/74 |
| 2,839,140 | 6/1958 | Vogt | 225/74 |
| 3,036,751 | 5/1962 | Bartschi | 225/51 X |
| 3,104,043 | 9/1963 | Wyant | 225/74 |
| 3,190,520 | 6/1965 | Wyant | 225/73 |
| 3,232,505 | 2/1966 | Wyant | 225/74 |
| 4,466,563 | 8/1984 | Zuss | 225/74 |

FOREIGN PATENT DOCUMENTS

| | | | |
|---|---|---|---|
| 2818347 | 11/1978 | Fed. Rep. of Germany | 225/84 |
| 1596772 | 8/1981 | United Kingdom | 225/74 |

*Primary Examiner*—Douglas D. Watts
*Assistant Examiner*—Rinaldi Rada
*Attorney, Agent, or Firm*—Stanley J. Price, Jr.

[57] ABSTRACT

A dispenser for dispensing a preselected length of strip material from a roll in which the dispenser has a housing with a cover member pivotally connected to the housing. The cover member has an elongated transversely extending slot with a bracket member extending therethrough and pivotally supported intermediate its edge portions to the cover with a portion extending into the housing and a portion extending outside of the housing through the slot. The bracket member rear edge portion is arranged to pivot upwardly against the inner surface of the cover and abut the inner surface of the cover to frictionally engage the paper therebetween. The bracket front edge forms a knife edge for severing a preselected length of strip material from the roll when the material is pulled downwardly against the knife edge portion of the bracket. The bracket member is arranged to be pivoted upwardly by the strip material to release the back edge of the bracket member and permit the withdrawal of a length of paper from the roll.

4 Claims, 1 Drawing Sheet

APPARATUS FOR DISPENSING STRIP MATERIAL FROM A ROLL

BACKGROUND OF THE INVENTION

1. Field of the Invention

This invention relates to a method and apparatus for dispensing preselected lengths of strip material from a roll and particularly to a dispenser that includes a pivoted bracket member which frictionally engages a portion of the strip material while it is being severed from the roll.

Throughout the specification and claims the term strip material is intended to designate thin sheets or web wound as a roll that has a cylindrical configuration. The strip material may be thin bendable plastic material, metallic film, paper products such as paper towels and the like which are capable of being severed or cut by being pulled against the resistance of a knife edge on a dispenser.

2. Description of the Prior Art

Dispensers for strip materials are known. U.S. Pat. No. 4,130,228 discloses a container for a roll of wax paper that has a serrated edge portion concealed during shipment and thereafter exposed for severing a preselected length of wax paper.

U.S. Pat. Nos. 2,314,849, 2,336,842 and 2,331,651 disclose similar dispensers which require one hand to frictionally hold the strip of paper while the other hand severs the strip from the roll. U.S. Pat. No. 2,405,459 discloses a dispenser with a multi-ply front wall which provides a rigid serrated edge for severing the strip from the roll. U.S. Pat. No. 3,843,034 discloses a clamping blade and elastic back up member to sever the strip from the roll. U.S. Pat. No. 4,267,949 discloses a dispenser for separating a tape along oblique slots by a combination of guide channels and a member that presses the tape into engagement with the guide channels. U.S. Pat. No. 2,613,879 discloses elastic jaws between which the strip is squeezed as the free end portion is severed from the roll.

U.S. Pat. Nos. 1,122,674 and 1,122,673 disclose paper towel dispensers which include fingers or toothed edges to disengage or sever the towel along transverse perforations.

U.S. Pat. No. 2,683,641 discloses a dispenser with a downwardly facing serrated edge on a flange above a dispensing lip which permits severing of the strip by an upward pull against the serrated edge.

U.S. Pat. No. 3,702,672 discloses a plastic bag dispenser where friction rings limit the dispensing of the bags and a large U-shaped friction surface provides the friction to separate the bags at the perforated boundary. A serrated knife edge is not used to sever a bag from the roll.

U.S. Pat. No. 4,244,502 discloses a ticket dispenser where the ticket has curved slits and the downward pull on the ticket, severs the ticket at the slits by an indexing member. U.S. Pat. No. 4,384,664 discloses a dispenser for serial number tickets where the tickets have a central lip and the lateral edges are severed by the dispenser.

There is a need for a dispenser where a vertical movement of the strip of material in one direction permits strip material to be withdrawn from a dispenser and movement of the strip material in the opposite direction permits the length of strip material withdrawn from the dispenser to be severed from the roll.

SUMMARY OF THE INVENTION

The invention relates to both a method and apparatus for dispensing a preselected length of strip material from a roll. The apparatus includes a housing having an elongated, slotted portion with a bracket member positioned therein. The bracket member has a rear edge portion and a front knife edge portion. The rear end portion is positioned within the housing and the front knife edge portion is positioned outside of the housing. The bracket member is pivotally supported in the housing so that the bracket rear edge portion is movable into abutting relation with the inner surface of the housing to frictionally engage the strip material therebetween while a preselected length of the strip material is severed along the bracket front knife edge portion.

The method includes the steps of positioning a roll of strip material in a dispenser housing and pulling the free end of the strip material from the roll through a slotted opening in the housing. The free end of the strip material is pulled downwardly against the knife edge of the bracket member to pivot the bracket member supported in the housing slotted opening to simultaneously, frictionally engage a rearwardly spaced portion of the strip material to the inner surface of the housing while severing the strip material along the knife edge of the bracket member.

The herein described dispenser depends on the vertical movement of the strip material in one direction to permit the strip material to be withdrawn from the dispenser and movement of the strip material in an opposite direction permits the strip material to be frictionally engaged to the dispenser and the severing of a portion of the strip material from the roll.

Accordingly, the principal object of this invention is to provide a dispenser in which the movement of the strip material controls the withdrawal of the strip material from the dispenser and also controls frictionally engaging the strip material to the dispenser and the severing of a portion of the strip material from the roll.

DESCRIPTION OF THE PREFERRED EMBODIMENT

Figure 1:
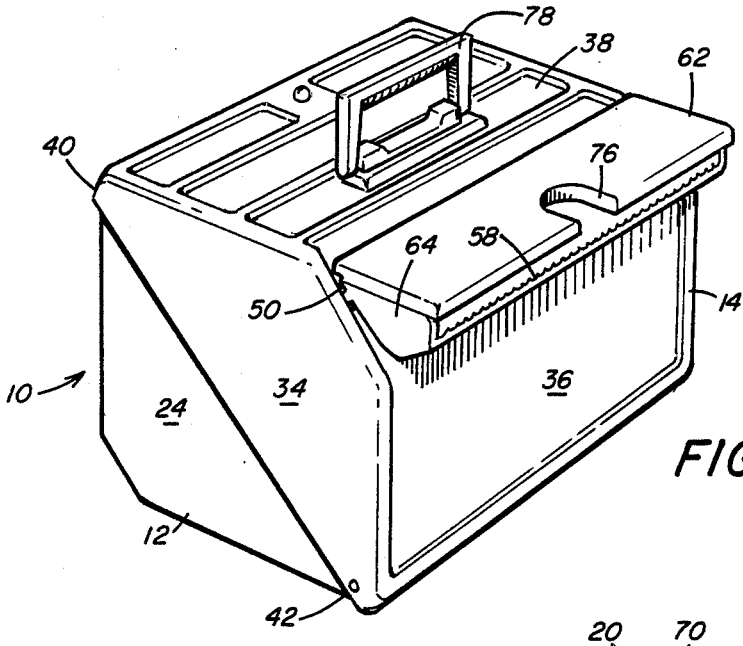
FIG. 1 is a perspective view of the dispenser.
Figure 2:
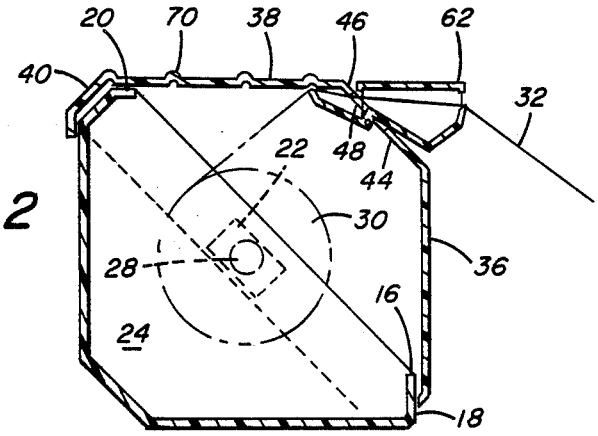
FIG. 2 is a view in side elevation and section illustrating the configuration of the housing, cover and bracket member with a roll of strip material positioned therein and an end portion of the strip material extending through the slot to a location outside of the dispenser.

Referring to the drawings and particularly FIGS. 1 and 2, there is illustrated a dispenser generally designated by the numeral 10. The dispenser has a housing portion 12 and a cover portion 14. The housing 12 has an upturned edge portion 18 and a downturned top flange 20. With this configuration, the housing 12 has an opening in which a roll support 22 is secured to each side wall 24 of housing 12 below the upper edge 16 of side walls 24. The roll support 22 has a generally U-shaped configuration to receive end caps (not shown) which are secured to the roll central tube 28. Thus, a roll of paper towels or the like 30 is rotatably supported within the housing 12 and has a free end 32 arranged to be unwound from the roll. The roll of material will be referred to as strip material with an unwound portion, or free end 32.

The cover member 14 has a pair of side walls 34 with portions in overlapping relation with the side walls 24 of the housing 12 and portions extending over the housing side wall edge 16. The cover 14 has a front wall 36 and a top wall 38. A downwardly bent flange 40 on cover top wall 38 extends over the downturned top flange 20 of housing 12.

It should be understood that the housing 12 has a bottom wall, a rear wall and a pair of spaced side walls 24 for receiving and supporting a roll of paper 30 therein. The cover member also has a pair of side walls 34, a front wall 36 and a top wall 38. The cover member 14 has the side walls 34 pivotally connected by pivot pins 42 to the side walls 24 of the housing 12 the cover can be pivoted to open the housing for positioning a roll of paper in the dispenser 10. The downwardly depending portion 40 of the cover top wall may be secured to the housing 12 by any suitable means such as a screw, clip or the like (not shown).

The cover member front wall 36 has an inturned angular upper end portion 44 and the cover top wall 38 has a downturned edge portion 46 to form an elongated transverse slot 48 in the cover member. The strip material or free end portion of the roll 32 is arranged to extend through the slot 48.

A bracket member, generally designated by the numeral 50 is pivotally positioned within the slot 48. Because of the configuration of the slot and the dimensions of the bracket member, the bracket member does not require a pivot pin type connection to the side wall of the cover member 14 to be supported and pivotally moveable therein. It should be understood, however, where desired, the bracket member can be suitably connected to the side wall 34 of cover member 14 to permit the pivoting of the bracket member about a fixed pivot axis.

The bracket member 50 has an intermediate body portion 52, a front end portion 54 and a rear end portion 56. The front end portion 54 has an upstanding knife edge 58 and the rear portion 56 has an upstanding engaging edge 60. The bracket 50 has a cover member 62 with depending side walls 64 which are secured to the bracket front end portion 54. The bracket cover 62 has a depending edge portion 66 to provide a slot 68 between the depending portion 66 and knife edge 58.

The top 38 of cover member 14 may have strengthening ribs 70 formed therein and in one embodiment the upstanding engaging edge 60 of bracket rear portion 56 may extend into a recessed portion 72 formed by the rib 70.

The free end 32 of the strip material unrolled from the roll 30 is threaded between the undersurface 74 of the cover top wall 38 and the engaging edge 60 of bracket rear end portion 56. The strip material 32 is then threaded through the elongated slot 48 in the cover 14, under the bracket cover 62 and through the slot 68 formed between bracket cover 62 and the bracket front end portion 54.

The bracket cover 62 has a U-shaped recess 76 therein for the operator to grasp the end 32 of the strip material after it has been severed with the knife edge 58 of bracket 50.

The dispenser 10 operates in the following manner. A roll of flexible strip material 30, such as a roll of paper towels or the like, is positioned in the housing 12 and supported by means of the roll brackets 22 so that the roll is freely rotatable within the housing 12. The strip material free end 32 is then threaded through the bracket member between the underside 74 of cover top wall 38 and the rear portion 56 of bracket member 50. The strip material is then threaded through the slot 48 in cover member 14 and through the slot 68 in the bracket member 50.

Figure 3:
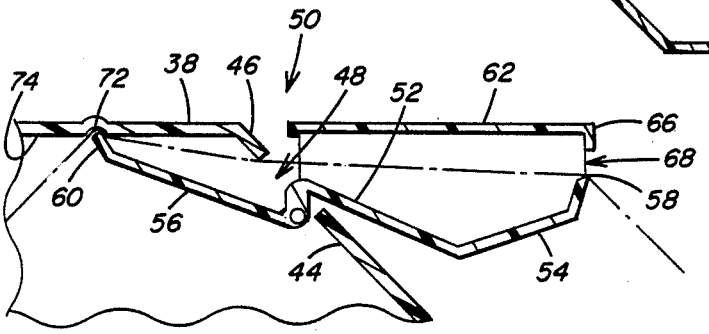
FIG. 3 is a fragmentary section of the bracket member in elevation illustrating the downward force exerted on the bracket member by the strip material to frictionally engage a portion of the strip material to the underside of the cover.
Figure 4:
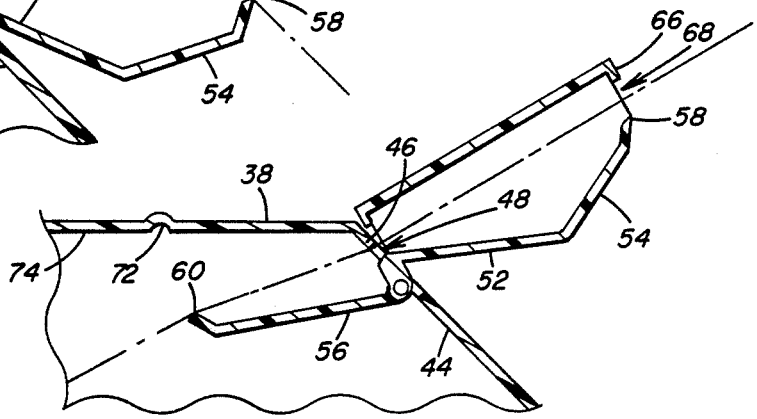
FIG. 4 is a view similar to FIG. 3 illustrating the upward movement of the bracket member to permit the strip material to be unrolled from the roll positioned in the housing.

To withdraw a length of strip material from the dispenser 10 the end 32 of the strip material is first moved upwardly as is illustrated in FIG. 4. In this position, the strip material may be freely unwound from the roll 30 with little if any frictional resistance from the dispenser components. When the desired length of the strip material has been withdrawn from the housing, the strip material end portion 32 is moved downwardly to pivot the bracket member 50 downwardly therewith as illustrated in FIG. 3 so that the rear edge portion 60 is moved into abutting relation with the undersurface 74 of cover 38 with a portion of the unwound strip material therebetween. The greater the downward force exerted by the free unwound end of the strip material 32, the greater the friction between the strip material and the bracket edge member 70 and under surface 74 of the housing cover 38. This friction resistance stops any further withdrawal of the strip material from the housing 12. When the downward force on the strip material end portion 32 is further increased, the strip material is severed along the knife edge portion 58 of bracket member 50. The knife edge portion severs the strip material adjacent the end of the bracket cover member 62 to protect the edge of the strip material 32. When it is desired to withdraw another length of strip material 32, the strip material is grasped through the recess 76 and moved upwardly to permit the unwinding and withdrawal of strip material from the dispenser.

It should be noted that the cover top wall 38 includes a handle 78 to provide a portable dispenser for paper towels or the like. Other devices may be connected to the external walls of the housing or the cover member where desired. With this arrangement, there is provided a portable dispenser that does not require a two hand operation for withdrawing and severing preselected lengths of strip material.

According to the provisions of the Patent Statutes, I have explained the principle, preferred construction and mode of operation of my invention and have illustrated and described what I now consider to represent its best embodiments. However, it should be understood that, within the scope of the appended claims, the invention may be practiced otherwise than as specifically illustrated and described.

I claim:

1. Apparatus for dispensing a preselected length of strip material from a roll comprising, a housing having an inner surface top wall and an elongated slotted portion, a bracket member having a rear edge portion and a front edge portion, said bracket member positioned in said slotted portion of said housing with said rear edge portion within said housing and said front edge portion having an upstanding cutting portion positioned outside of said housing, said bracket member movably supported in said housing so that said bracket rear edge portion is movable into abutting relation with said housing inner surface top wall to frictionally engage the strip material therebetween while a preselected length of said strip material is severed along said upstanding cutting portion, said bracket member having an intermediate portion, and a cover portion positioned over said intermediate portion, and said cover portion having an opening therein for gripping said strip material.

2. Apparatus for dispensing a preselected length of strip material from a roll comprising, a housing having a top wall and an elongated slotted portion, said top wall having an inner surface, said top wall inner surface having a strengthening means which includes an elongated recessed portion, a bracket member having a rear edge portion with an upwardly flanged edge portion, said bracket member having a front edge portion with an upstanding cutting portion, said bracket member positioned in said slotted portion of said housing with said rear edge portion within said housing and said front edge upstanding cutting portion positioned outside of said housing, and said bracket member movably supported in said housing so that said upwardly flanged edge portion is movable into said recessed portion to frictionally engage said strip material therebetween while a preselected length of said strip material is severed along said front edge upstanding cutting portion.

3. Apparatus for dispensing a preselected length of strip material from a roll as set forth in claim 2 in which, said bracket member includes an intermediate portion, a cover portion positioned over said intermediate portion, said cover portion having an opening therein for gripping the free end of said strip material.

4. Apparatus for dispensing a preselected length of strip material from a roll as set forth in claim 3 in which, said elongated slotted portion forming an upper edge portion in said housing.

* * * * *